US007658887B2

(12) United States Patent
Hovatter

(10) Patent No.: US 7,658,887 B2
(45) Date of Patent: Feb. 9, 2010

(54) PIPETTE TIP GRID WITH LOCK MECHANISM

(75) Inventor: Kenneth R. Hovatter, Lodi, CA (US)

(73) Assignee: Scientific Specialties, Inc., Lodi, CA (US)

( * ) Notice: Subject to any disclaimer, the term of this patent is extended or adjusted under 35 U.S.C. 154(b) by 689 days.

(21) Appl. No.: 10/934,613

(22) Filed: Sep. 2, 2004

(65) Prior Publication Data

US 2006/0045815 A1 Mar. 2, 2006

(51) Int. Cl.
*B01L 9/00* (2006.01)
*B01L 3/00* (2006.01)
*B65D 21/00* (2006.01)

(52) U.S. Cl. ..... 422/104; 422/99; 422/102; 206/503; 206/507; 206/562; 211/194; 211/60.1; 211/85.17

(58) Field of Classification Search ..... 206/499, 206/508, 503, 506, 507, 561–563; 422/99, 422/102, 100, 104; 211/194, 60.1, 85.17, 211/88.01
See application file for complete search history.

(56) References Cited

U.S. PATENT DOCUMENTS 5,366,088 A * 11/1994 Hill et al. ..... 206/499
5,441,702 A * 8/1995 Lemieux et al. ..... 422/100
5,588,792 A * 12/1996 Tiso ..... 414/404
5,622,676 A * 4/1997 Lind ..... 422/104
5,642,816 A * 7/1997 Kelly et al. ..... 211/60.1
6,019,225 A * 2/2000 Kalmakis et al. ..... 206/563
6,534,015 B1 * 3/2003 Viot et al. ..... 422/102
2005/0150808 A1 * 7/2005 Sarna et al. ..... 206/562

OTHER PUBLICATIONS

"CMS/Fisher HealthCare 98/99," Fisher Scientific, pp. 833, 1998-1999 and pp. 827-830.
Applied Scientific, pp. 72-74, Jul. 1, 1996.
"Eppendorf Products and Applications for the Laboratory 2004," Brinkmann, pp. 38-41, 2004.
"The VWR Scientific Products Catalog," VWR Scintific Products, pp. 1297-1300, 1997-1998.

* cited by examiner

*Primary Examiner*—Brian R Gordon
(74) *Attorney, Agent, or Firm*—Carr & Ferrell LLP

(57) ABSTRACT

Pipette tip grids with holes for holding pipette tips and packages for the grids are provided. A pipette tip grid package comprises a grid, a base for supporting the grid, and a lock mechanism coupled to the grid and configured to externally engage with a sidewall of the base. The sidewall of the base also supports the grid. The package also can have a detachable cover for the grid, and, the lock mechanism can be external to the cover as well as the base. In some embodiments, the grids are stackable and the cover engages the topmost grid of the stack. Together, the cover, the base, and the sidewalls of the one or more stacked pipette tip grids form a protective case around pipette tips in the one or more grids.

15 Claims, 7 Drawing Sheets

PIPETTE TIP GRID WITH LOCK MECHANISM

BACKGROUND OF THE INVENTION

1. Field of the Invention

The present invention relates generally to the field of laboratory equipment, and more particularly to arrays of disposable pipette tips for pipetting systems.

2. Description of the Prior Art

In chemical, biological, pharmaceutical, and similar fields, laboratory handling of very small quantities of fluids is commonly performed with pipettes. In many instances, automated pipetting systems allow multiple fluid samples to be handled rapidly and in parallel while maintaining a very high degree of precision over the sample quantities. Often, such automated pipetting systems employ disposable pipette tips to prevent contamination from one sample to the next. Typically, pipette tips are provided to an automated pipetting system in a pipette tip rack or grid. In the pipette tip grid, the tips are typically arranged in rows where the number of tips in a row is equal to the number of parallel pipettes in the automated pipetting system. Accordingly, the automated pipetting system can readily pick up a row or multiple rows of tips from the grid.

It will be appreciated that disposable pipette tips need to be kept free of contamination to be acceptable for most applications. Accordingly, grids are packaged for shipping, handling, and storage. FIG. 1 illustrates a prior art pipette tip grid 100 supported within a protective box 102. The box 102 includes a hinged lid 104 that pivots to open and close. As can be seen from FIG. 2, locking tabs 106 attached to the grid 100 secure the grid 100 within the box 102. To release the grid 100 from the box 102, the locking tabs 106 are depressed and then the grid 100 can be removed. As shown in FIG. 3, when the lid 104 is closed the locking tabs 106 are also covered. Accordingly, to take the grid 100 out of the case 102 requires opening the lid 104 which exposes tops of pipette tips 108 to contamination.

As can be seen from FIG. 4, the grids 100 of the prior art can be stacked. When stacked, the pipette tips 108 in one grid 100 nest in the pipette tips 108 of the grid 100 beneath. Unfortunately, the lid 104 will not close over a stack of grids 100, and therefore the lid 104 is preferably removed, as shown. It can be seen that the tops of the pipette tips 108 are exposed, as are the sides of the pipette tips 108.

Accordingly, what is needed is improved packaging for pipette tips.

SUMMARY

The present invention provides grids with holes for holding pipette tips and packages for the pipette tip grids. A pipette tip grid package comprises a pipette tip grid, a base for supporting the pipette tip grid, and a lock mechanism coupled to the pipette tip grid. The lock mechanism is configured to externally engage with a sidewall of the base to secure the pipette tip grid to the base. Releasing the lock mechanism allows the pipette tip grid to be detached from the base.

The sidewall of the base also supports the pipette tip grid, and in some embodiments the pipette tip grid nests inside of the sidewall. In some embodiments, a flange on the pipette tip grid rests on a top edge of the sidewall of the base. In other embodiments, the sidewall includes an interior ledge for supporting a bottom edge of the pipette tip grid. Further embodiments may employ both the flange on the pipette tip grid and the interior ledge of the sidewall. In some embodiments, the pipette tip grids are configured to be stacked.

Additional embodiments of the pipette tip grid package further comprise a cover supported by the pipette tip grid and detachable therefrom. Preferably, the lock mechanism is external to the cover as well as the base. In this way, without having to remove the cover from the pipette tip grid, the lock mechanism can be accessed to detach the pipette tip grid from the base, so that the pipette tip grid and the cover are removed together. Advantageously, when multiple pipette tip grids are stacked on the base, the cover engages the topmost pipette tip grid of the stack. Together, the cover, the base, and the sidewalls of the one or more stacked pipette tip grids form a protective case around pipette tips on the one or more grids.

Still other embodiments of the pipette tip grid package include a lock mechanism that allows stacked grids to be interlocking. An exemplary interlocking pipette tip grid package includes a first pipette tip grid including a lock mechanism configured to externally engage with a base, and a second pipette tip grid including a lock mechanism configured to externally engage with first pipette tip grid. Preferably, the first and second pipette tip grids are interchangeable.

DETAILED DESCRIPTION

The present invention provides a stackable pipette tip grid including a lock mechanism and an associated case for the pipette tip grid that overcomes problems with the prior art. One or more stackable grids can be disposed between a base and a cover of the case. The lock mechanism of the pipette tip grid secures the grid to the base. Advantageously, the lock mechanism is disposed externally to both the base and the cover so that the lock mechanism can be accessed without removing the cover from the grid. Accordingly, the lock mechanism allows the grid to be removed from the base while the cover remains in place over the grid. To better understand the advantages of the present invention, the stackable pipette tip grid will be described generally with respect to FIGS. 5-10, and an embodiment of the lock mechanism will be described with respect to FIG. 11.

Figure 6:
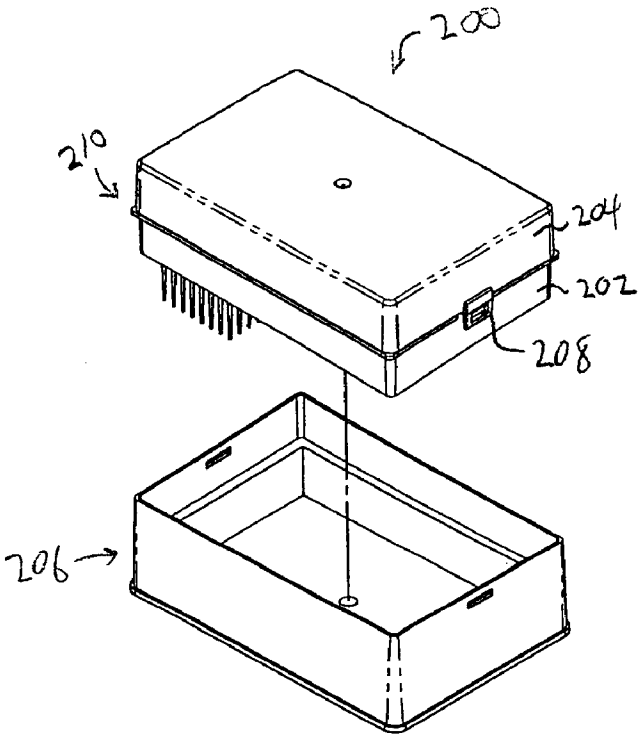
FIG. 6 is a partially exploded view of the housing of FIG. 5.
Figure 5:
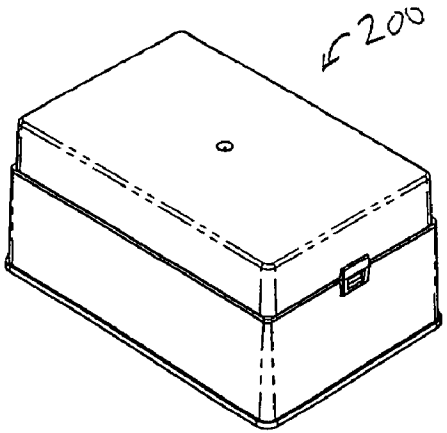
FIG. 5 is a perspective view of a housing closed around a stackable pipette tip grid according to an embodiment of the present invention.

FIG. 5 shows a perspective view of an exemplary pipette tip grid package 200 according to an embodiment of the invention. As configured in FIG. 5, a case of the package 200 encloses a stackable pipette tip grid 202 (not shown). FIG. 6 shows a partially exploded perspective view of the package 200. The case of the package 200 includes a cover 204 and a base 206. As can be seen from FIG. 6, the grid 202 includes a lock mechanism 208. Further, the grid 202 and the cover 204 together comprise a grid assembly 210 that can be detached from the base 206 as a unit.

Figure 7:
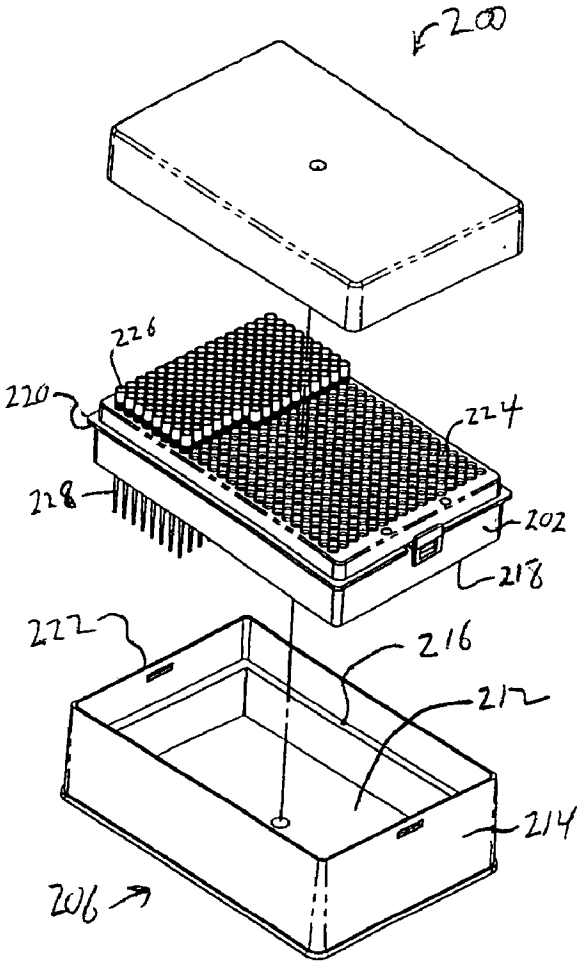
FIG. 7 is a fully exploded view of the stackable pipette grid of FIG. 5.

It can be seen from FIGS. 6 and 7 that the base 206 is essentially a box opened at a top side. Accordingly, the base 206 includes a bottom 212, opposite the opened top side of the box, and a sidewall 214 that extends from the bottom 212 to form four sides of the box. In some embodiments of the present invention, the bottom 212 and the sidewall 214 are integral, for example, by being formed together by a process such as injection molding. In other embodiments, the bottom 212 and the sidewall 214 are bonded together to form the base 206.

The base 206 is configured to receive the grid 202 such that the grid 202 nests securely inside of the base 206. In some instances, the grid 202 is fully enclosed by the base 206. To this end, the sidewall 214 of the base 206 can include an interior ledge 216. A bottom edge 218 of the grid 202 rests on the interior ledge 216 when the grid 202 is set inside of the base 206. Alternately, the grid 202 can include a flange 220 that rests on a top edge 222 of the sidewall 214. In further embodiments, the base 206 includes the interior ledge 216, and the grid 202 includes the flange 220 as shown in FIGS. 6 and 7.

As can be seen, the grid 202 includes a plurality of holes 224 for receiving pipette tips 226. In some embodiments, the grid 202 can support 96 pipette tips 226 in a square array, though it will be appreciated that the grid 202 can, in principle, be configured to support any number of pipette tips 226 in any pattern or arrangement according to the needs of different pipetting systems. One alternative pattern is a hexagonal array, for example.

When the grid 202 is nested in the base 206, ends 228 of the pipette tips 226 are enclosed by the base 206 to keep the ends 228 free from contamination and damage. Similarly, the cover 204 is configured to engage the grid 202 to cover the tops of the pipette tips 226 to protect the tops and prevent contamination. In those embodiments in which the grid 202 includes the flange 220, the cover 204 can rest on the flange 220 when the two are fully engaged. As shown in FIG. 6, the entire grid assembly 210 can be advantageously removed from the base 206 while the cover 204 remains in place over the grid 202.

Figure 1:
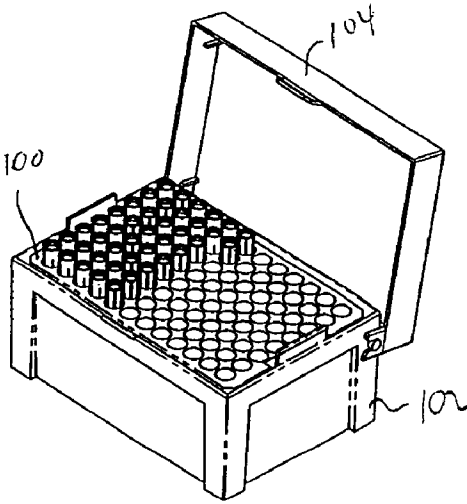
FIG. 1 (Prior Art)
FIG. 1 is a perspective view of a pipette tip grid supported in a case according to the prior art.
Figure 2:
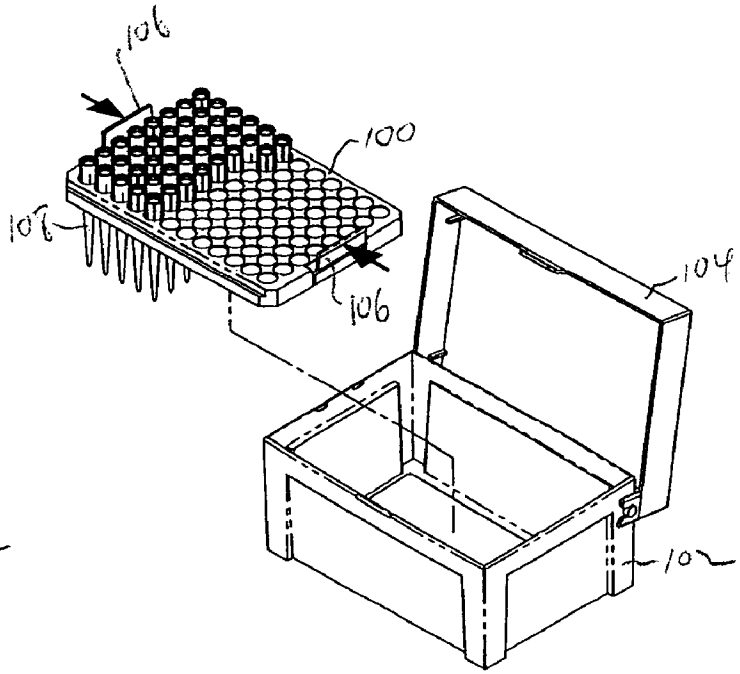
FIG. 2 (Prior Art)
FIG. 2 is a perspective view of the pipette tip grid of FIG. 1 removed from the case.
Figure 3:
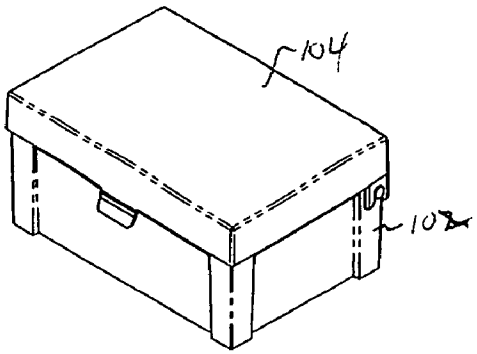
FIG. 3 (Prior Art)
FIG. 3 is a perspective view of the case of FIG. 1 within a closed lid.
Figure 8:
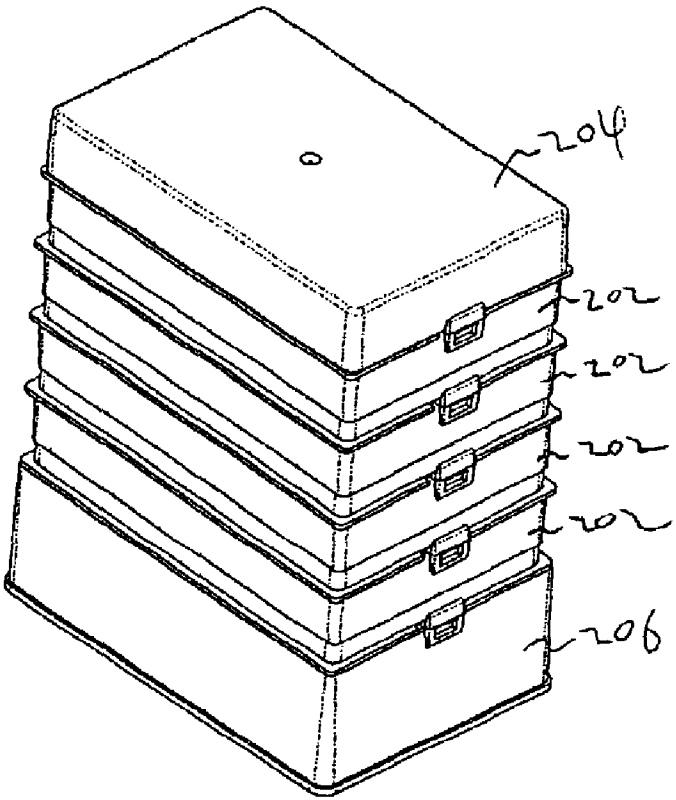
FIG. 8 is a perspective view of the housing closed around multiple stackable pipette tip grids according to an embodiment of the present invention.
Figure 4:
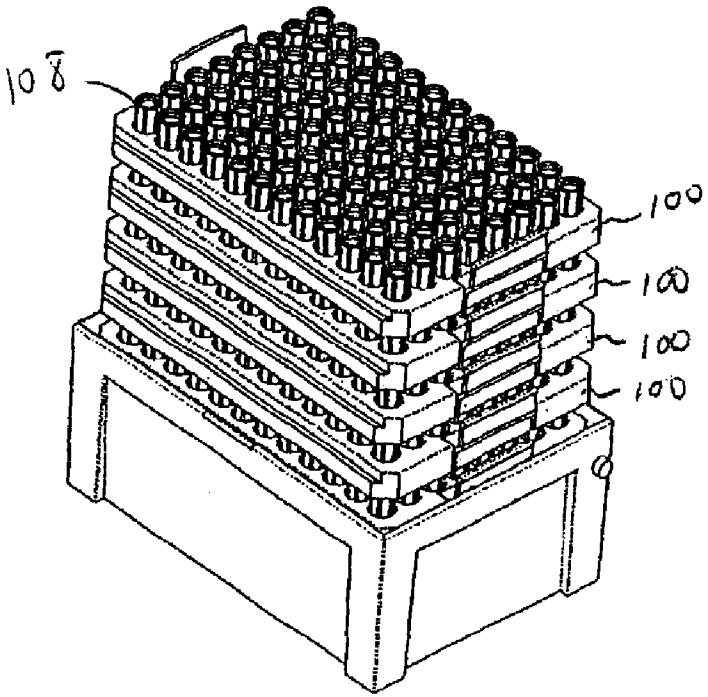
FIG. 4 (Prior Art)
FIG. 4 is a perspective view of multiple pipette tip grids in a stacked arrangement according to an embodiment of the prior art.

FIG. 8 shows multiple grids 202 in a stacked arrangement between the base 206 and the cover 204. In the stacked arrangement, pipette tips 226 in one grid 202 nest in the pipette tips 226 of the grid 202 beneath. Additionally, the bottom edge 218 of one grid 202 rests on the flange 220 of the grid 202 beneath. It can be seen from the comparison of the stacked arrangement of FIG. 8 to the prior art stacked arrangement shown in FIG. 4 that the stacked arrangement of the present invention provides advantages over the prior art. For example, the sidewalls of the grids 202, together with the cover 204 and base 206, create a complete barrier to contamination that is absent in the prior art. Further, the cover 204 works with the stacked arrangement regardless of the number of stacked grids 202.

Figure 11:
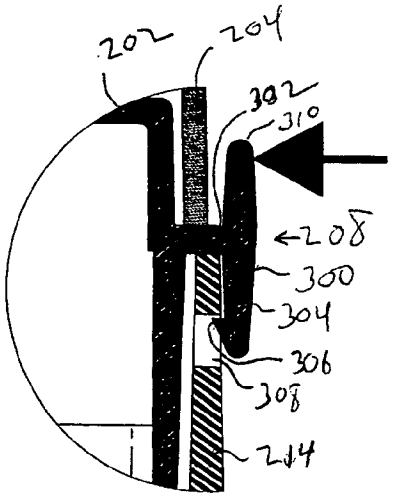
FIG. 11 is a cross-sectional view of a lock mechanism of the grid of FIG. 8.
Figure 10:
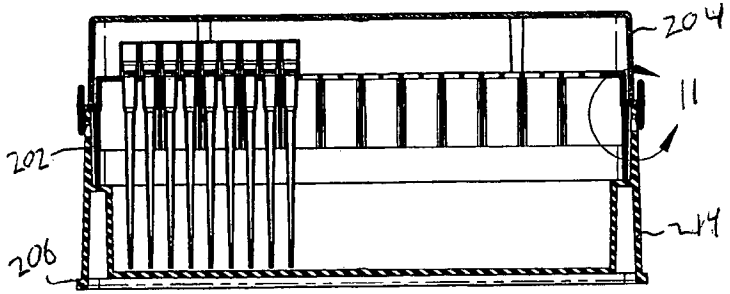
FIG. 10 is a cross-sectional view of the grid of FIG. 8.
Figure 9:
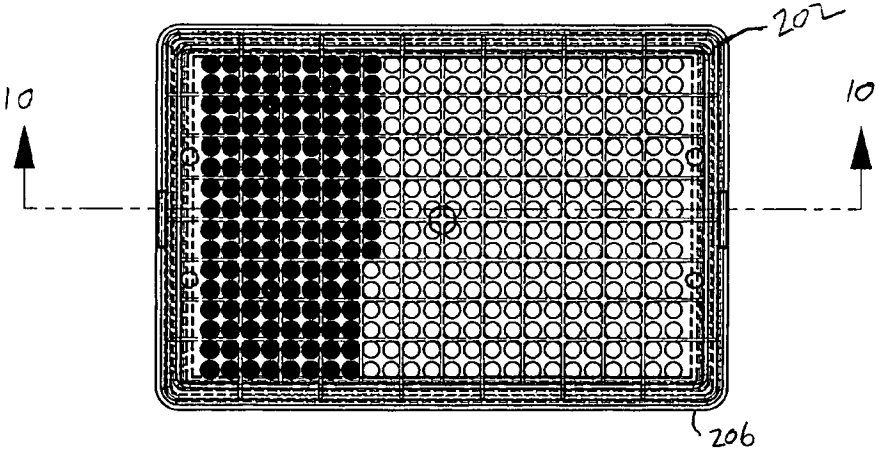
FIG. 9 is a top view of a stackable pipette grid according to an embodiment of the present invention.
Figure 13:
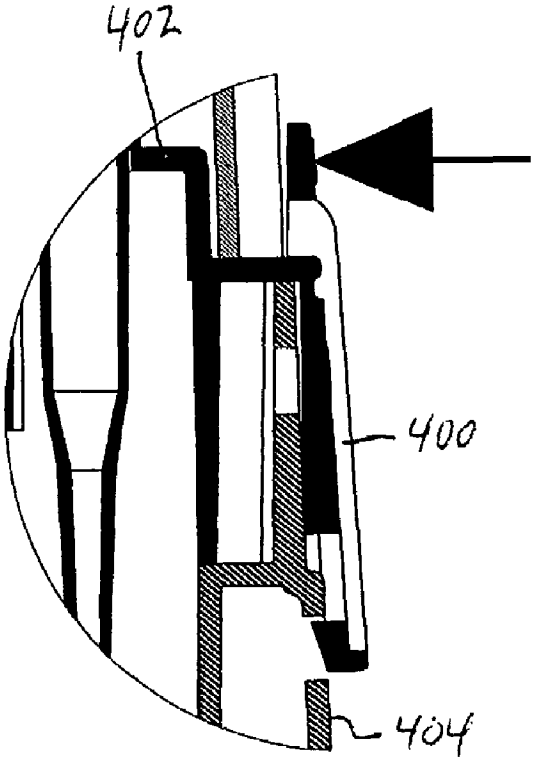
FIG. 13 is a cross-sectional view of a lock mechanism of the grid of FIG. 12.

As noted above, the grid 202 further includes a lock mechanism 208. The lock mechanism 208 is coupled to the grid 202 and configured to externally engage with the sidewall 214 of the base 206. FIGS. 9-11 show the relationship of the lock mechanism 208 to the base 206 and cover 204 in more detail. FIG. 9 is a top view of the pipette tip grid 202 nested in the base 206. FIG. 10 is a cross-section through the grid 202 and base 206 along the line 10-10 and also through the cover 204 (absent from FIG. 9 for clarity). An enlarged view of a portion of the cross-section of FIG. 10 shows an exemplary embodiment of the lock mechanism 208 in FIG. 11.

It can be seen from FIGS. 10 and 11 that the lock mechanism 208 is both external to the base 206 and to the cover 204. Accordingly, the cover 204 does not have to be removed from the grid 202 in order to access the lock mechanism 208 as in the prior art. Thus, the entire grid assembly 210 can be advantageously detached from the base 206 while the cover 204 remains in place to protect the tops of the pipette tips 226.

As noted, FIG. 11 shows one exemplary lock mechanism 208 of the present invention, though the invention is not limited to this particular embodiment. The lock mechanism 208 includes a lever 300 that is configured to pivot around an attachment point 302 to the grid 202. The attachment point 302 can be, for example, a segment of the flange 220 (FIG. 7). A bottom portion 304 of the lever 300 includes a lip 306 that engages a corresponding recess 308 in the sidewall 214 of the base 206. The recess 308 is shown in FIG. 11 as an aperture through the sidewall 214, but could also be a molded indentation, for example. It can be seen that when a top portion 310 of the lever 300 is pushed towards the cover 204, the lip 306 disengages from the recess 308 in the sidewall 214 so that the grid 202 can detach from the base 206.

In some embodiments of the invention, as shown in FIG. 11, the lock mechanism 208, the grid 202, and the attachment point 302 therebetween are integrally formed. In other embodiments, the attachment point 302 constitutes a device such as a hinge or spring that couples the lock mechanism 208 to the grid 202. In either instance, the material or device at the attachment point 302 preferably has sufficient resiliency to return the lip 306 to a position where it will readily re-engage with the recess 308 when the grid 202 is returned to the base 206.

Figure 12:
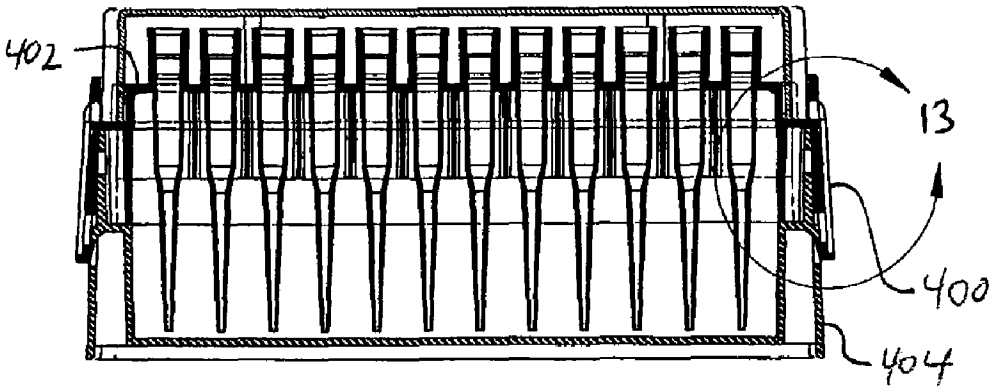
FIG. 12 is a cross-sectional view of a stackable pipette grid engaged to a base according to another embodiment of the invention.
Figure 15:
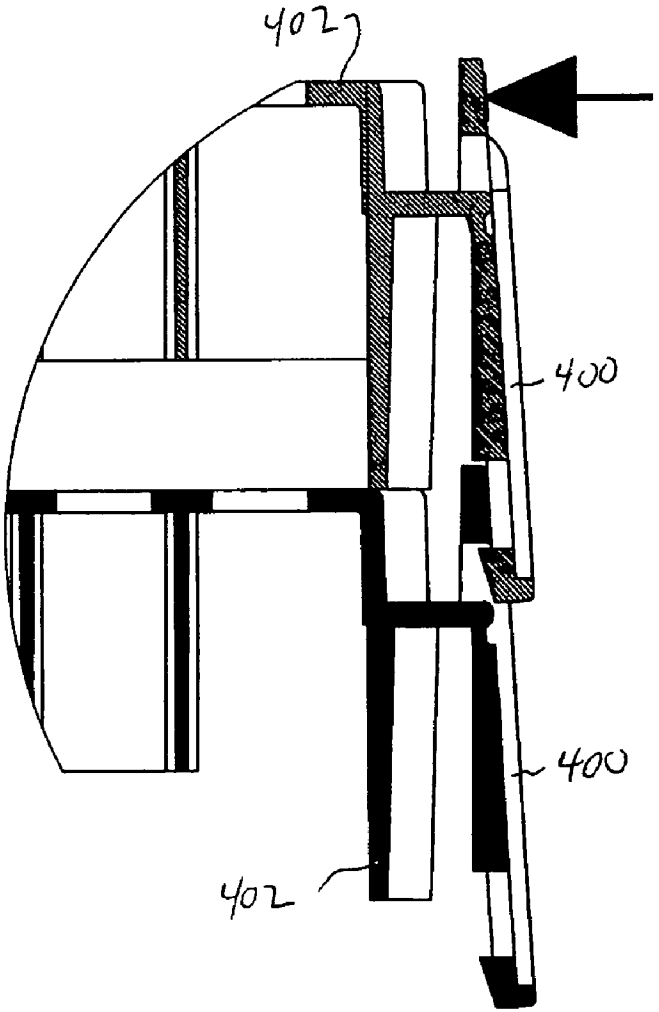
FIG. 15 is a cross-sectional view of the lock mechanisms of the interlocked grids of FIG. 14.
Figure 14:
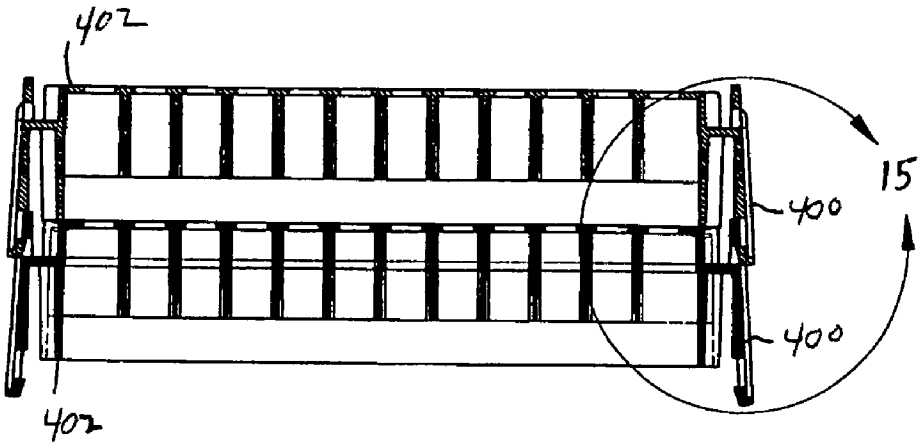
FIG. 14 is a cross-sectional view of the grid of FIG. 12 engaged to another such grid according to another embodiment of the invention.

Another embodiment of the invention is illustrated by FIGS. 12-16. In this embodiment a lock mechanism 400 of a grid 402 is configured to engage a base 404, as shown in the cross-section of FIG. 12. An enlarged view of a portion of the cross-section of FIG. 12 shows the lock mechanism 400 engaging the base 404 in greater detail in FIG. 13. Advantageously, lock mechanism 400 can also engage another grid 402 when the grids 402 are in an interlocked stacked arrangement as shown in the cross-section of FIG. 14. FIG. 15 is an enlarged view of a portion of the cross-section of FIG. 14 to show the lock mechanism 400 engaging the other grid 402 in greater detail.

Figure 16:
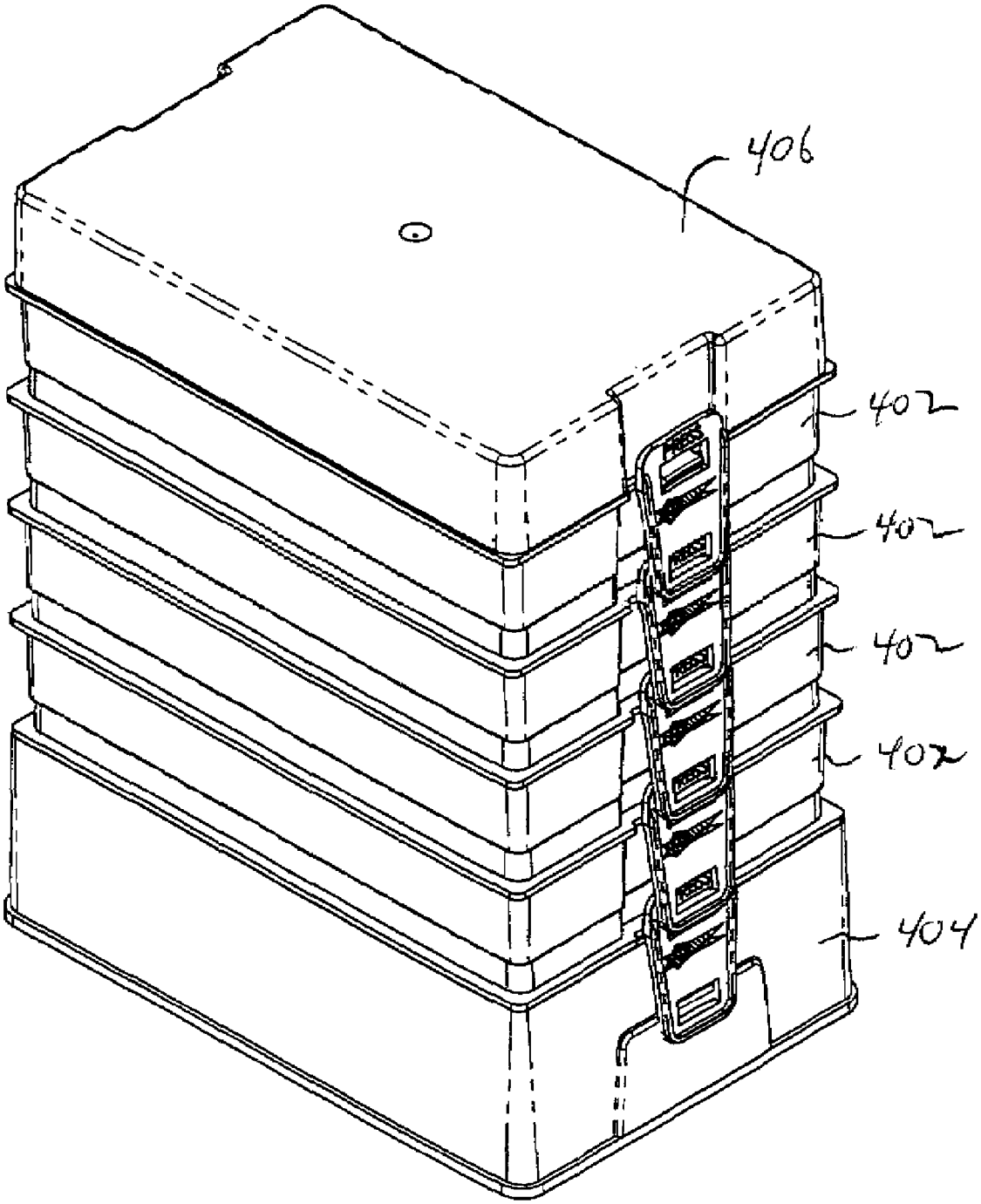
FIG. 16 is a perspective view of multiple grids of FIG. 12 in an interlocked stacked arrangement on a base and with a cover.

FIG. 16 shows a perspective view of multiple grids 402 in the interlocked stacked arrangement between the base 404 and a cover 406. It will be appreciated that because the lock mechanism 400 allows the grids 402 to interlock as shown, the interlocked stacked arrangement seen in FIG. 16 cannot be accidentally separated during shipping and storage. The lock mechanism 400 also provides greater stability to the interlocked stacked arrangement so that a greater number of grids 402 can be stacked together. For instance, more than 5 grids 402 can be conveniently interlocked according to this embodiment.

In some embodiments, the base 206, 404, the cover 204, 406 and the grid 202, 402 are manufactured from a material that is easy to form, that is relatively inexpensive, and that does not significantly outgas or shed particles. Plastic materials such as polypropylene work well. Glass filled polypropylene is a suitable material specifically for the grid 202, 402 as the glass filler provides additional stiffness. In some embodiments, the cover 204, 406 is made from a clear material to allow the pipette tips 226 to be readily seen without removing the cover 204, 406. Injection molding is a suitable method for manufacturing these components.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A pipette tip grid assembly, the assembly comprising:

a base including a bottom, a sidewall extending from the bottom, and an interior ledge extending from an interior surface of the sidewall;

a first detachable pipette tip grid having a top side and a bottom side, the bottom side including a bottom edge that rests on the interior ledge of the sidewall of the base, the first detachable pipette tip grid including a plurality of holes for receiving pipette tips, the first detachable pipette tip grid configured to support a pipette tip received in a hole of the plurality of holes, wherein a bottom part of the pipette tip protrudes from the hole toward the bottom side, and wherein the bottom side is enclosed by the sidewall of the base;

a detachable stacking layer that rests on and encloses the top side of the first detachable pipette tip grid; and a lock mechanism coupled to the first detachable pipette tip grid that releasably attaches to an exterior surface of the sidewall of the base, wherein the first detachable pipette tip grid can detach from the base without removing the detachable stacking layer.

2. The pipette tip grid assembly of claim 1, wherein the detachable stacking layer is a cover.

3. The pipette tip grid assembly of claim 1, wherein the bottom and the sidewall of the base are integral.

4. The pipette tip grid assembly of claim 1, wherein the first detachable pipette grid further includes an outwardly projecting flange for allowing the first detachable pipette tip grid to be supported on a top edge of the sidewall.

5. The pipette tip grid assembly of claim 1, wherein the detachable stacking layer is a second detachable pipette tip grid having a sidewall corresponding to a grid perimeter and extending from a bottom side of the second detachable pipette tip grid, wherein the sidewall of the second detachable pipette tip grid rests on and encloses the top side of the first detachable pipette tip grid; and a lock mechanism that releasably attaches to an exterior surface of a sidewall of the first detachable pipette tip grid.

6. The pipette tip grid assembly of claim 1, wherein the lock mechanism includes a lip that releasably attaches to the sidewall of the base.

7. The pipette tip grid assembly of claim 6, wherein the lip releasably attaches to a corresponding aperture through the sidewall of the base.

8. A pipette tip grid assembly, the assembly comprising:

a base including a bottom, a sidewall extending from the bottom, and an interior ledge extending from an interior surface of the sidewall;

a detachable pipette tip grid having a top side and a bottom side, the detachable pipette tip grid supported on the bottom side by the interior ledge of the sidewall of the base and including a plurality of holes for receiving pipette tips, the detachable pipette tip grid configured to support a pipette tip received in a hole of the plurality of holes, wherein a bottom part of the pipette tip protrudes through the hole toward the bottom side, and wherein the bottom side is enclosed by the sidewall of the base;

a detachable cover that encloses the top side of the detachable pipette tip grid; and a lock mechanism coupled to the detachable pipette tip grid that releasably attaches to an exterior surface of the sidewall of the base, wherein the detachable pipette tip grid can detach from the base without removing the cover.

9. The pipette tip grid assembly of claim 8, wherein the lock mechanism is external to the cover.

10. The pipette tip grid assembly of claim 8, wherein the cover is clear.

11. The pipette tip grid assembly of claim 8, further comprising pipette tips disposed through the plurality of holes.

12. The pipette tip grid assembly of claim 8, wherein the pipette tip grid further includes an outwardly projecting flange.

13. The pipette tip grid assembly of claim 12, wherein the cover is supported by the flange and the flange is supported by a top edge of the sidewall of the base.

14. An interlocking pipette tip grid assembly, the assembly comprising:

a base including a bottom, a sidewall extending from the bottom, and an interior ledge extending from an interior surface of the sidewall;

a first detachable pipette tip grid having a top side and a bottom side, the first detachable pipette tip grid including:

a plurality of holes for receiving pipette tips, the first detachable pipette tip grid configured to support a pipette tip received in a hole of the plurality of holes, wherein a bottom part of the pipette tip protrudes from the hole toward the bottom side, a bottom edge that rests on an interior ledge extending from an interior surface of the sidewall of the base, wherein the bottom side is enclosed by the sidewall of the base, and a first lock mechanism that releasably attaches to an exterior surface of the sidewall of the base; and a second pipette tip grid including:

a plurality of holes for receiving pipette tips, and a second lock mechanism that releasably attaches to an exterior surface of a sidewall of the first detachable pipette tip grid, wherein the second pipette tip grid encloses the top side of the first detachable pipette tip grid and wherein the first detachable pipette tip grid can detach from the base without disengaging from the second pipette tip grid.

15. The interlocking pipette tip grid assembly of claim 14, further comprising a removable cover that encloses a top side of the second pipette tip grid.

* * * * *

UNITED STATES PATENT AND TRADEMARK OFFICE

CERTIFICATE OF CORRECTION

PATENT NO. : 7,658,887 B2
APPLICATION NO. : 10/934613
DATED : February 9, 2010
INVENTOR(S) : Kenneth R. Hovatter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1204 days.

Signed and Sealed this

Thirtieth Day of November, 2010

David J. Kappos

David J. Kappos
*Director of the United States Patent and Trademark Office*